US005221376A

United States Patent [19]

Masumoto et al.

[11] Patent Number: 5,221,376

[45] Date of Patent: Jun. 22, 1993

[54] HIGH STRENGTH MAGNESIUM-BASED ALLOYS

[75] Inventors: Tsuyoshi Masumoto; Akihisa Inoue; Takashi Sakuma; Toshisuke Shibata, all of Sendai, Japan

[73] Assignees: Tsuyoshi Masumoto, Miyagi; Japan Metals & Chemicals Co., Ltd.; Yoshida Kogyo K.K., both of Tokyo, all of Japan

[21] Appl. No.: 820,546

[22] Filed: Jan. 14, 1992

Related U.S. Application Data

[62] Division of Ser. No. 712,187, Jun. 7, 1991, Pat. No. 5,118,368.

[30] Foreign Application Priority Data

Jun. 13, 1990 [JP] Japan ..... 2-152623

[51] Int. Cl.[5] ..... C22C 45/00; C22C 23/00

[52] U.S. Cl. ..... 148/403; 148/420; 164/415

[58] Field of Search ..... 148/403, 420; 164/415

[56] References Cited

U.S. PATENT DOCUMENTS 4,938,809 7/1990 Das et al. ..... 148/406
4,990,198 2/1991 Masumoto et al. ..... 148/403
5,087,304 2/1992 Chang et al. ..... 148/406
5,118,368 6/1992 Masumoto et al. ..... 148/403

FOREIGN PATENT DOCUMENTS 2201460 7/1973 Fed. Rep. of Germany .

*Primary Examiner*—Upendra Roy
*Attorney, Agent, or Firm*—Flynn, Thiel, Boutell & Tanis

[57] ABSTRACT

Disclosed are high strength magnesium-based alloys consisting essentially of a composition represented by the general formula (I) $Mg_aM_bX_d$, (II) $Mg_aLn_cX_d$ or (III) $Mg_aM_bLn_cX_d$, wherein M is at least one element selected from the group consisting of Ni, Cu, Al, Zn and Ca; Ln is at least one element selected from the group consisting of Y, La, Ce, Sm and Nd or a misch metal (Mm) which is a combination of rare earth elements; X is at least one element selected from the group consisting of Sr, Ba and Ga; and a, b, c and d are, in atomic percent, $55 \leqq a \leqq 95$, $3 \leqq b \leqq 25$, $1 \leqq c \leqq 15$ and $0.5 \leqq d \leqq 30$, the alloy being at least 50 percent by volume composed of an amorphous phase. Since the magnesium-based alloys of the present invention have high levels of hardness, strength, heat-resistance and workability, the magnesium-based alloys are useful for high strength materials and high heat-resistant materials in various industrial applications.

7 Claims, 1 Drawing Sheet

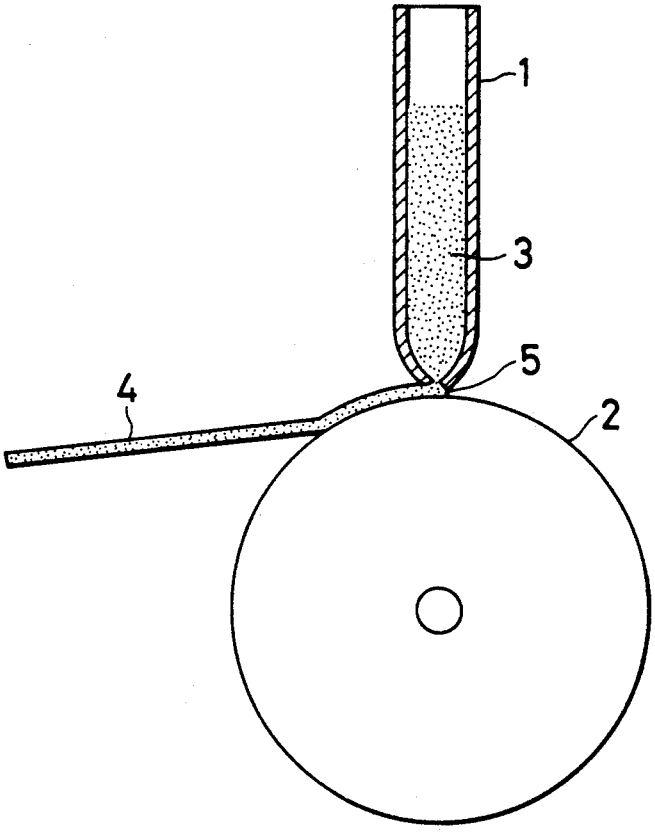
1
3
5
4
2

HIGH STRENGTH MAGNESIUM-BASED ALLOYS

This is a division of Ser. No. 07/712 187, filed Jun. 7, 1991, U.S. Pat. No. 5,118,368.

BACKGROUND OF THE INVENTION

1. Field of the Invention

The present invention relates to magnesium-based alloys which have a superior combination of properties of high hardness and high strength and are useful in various industrial applications.

2.Description of the Prior Art

As conventional magnesium-based alloys, there are known Mg-Al, Mg-Al-Zn, Mg-Th-Zr, Mg-Th-Zn-Zr, Mg-Zn-Zr, Mg-Zn-Zr-RE (RE: rare earth element), etc. and these known alloys have been extensively used in a wide variety of applications, for example, as lightweight structural component materials for aircraft, automobiles or the like, cell materials and sacrificial anode materials, according to their properties.

However, under the present circumstances, known magnesium-based alloys, as set forth above, have a low hardness and strength.

SUMMARY OF THE INVENTION

In view of the foregoing, it is an object of the present invention to provide novel magnesium-based alloys useful for various industrial applications, at a relatively low cost. More specifically, it is an object of the present invention to provide magnesium-based alloys which have an advantageous combination of properties of high hardness, strength and thermal resistance and which are useful as lightweight and high strength materials (i.e., high specific strength materials) and are readily processable, for example, extrusion or forging.

According to the present invention, the following high strength magnesium-based alloys are provided:

1. A high strength magnesium-based alloy consisting essentially of a composition represented by general formula (I):

$$Mg_aM_bX_d \quad (I)$$

wherein

M is at least one element selected from the group consisting of Ni, Cu, Al, Zn and Ca;

X is at least one element selected from the group consisting of Sr, Ba and Ga; and a, b and d are, in atomic %, $55 \leqq a \leqq 95$, $3 \leqq b \leqq 25$ and $0.5 \leqq d \leqq 30$, the alloy being at least 50 percent by volume composed of an amorphous phase.

2. A high strength magnesium-based alloy consisting essentially of a composition represented by general formula (II):

$$Mg_aLn_cX_d \quad (II)$$

wherein

Ln is at least one element selected from the group consisting of Y, La, Ce, Sm and Nd or a misch metal (Mm) which is a combination of rare earth elements;

X is at least one element selected from the group consisting of Sr, Ba and Ga; and a, c and d are, in atomic %, $55 \leqq a \leqq 95$, $1 \leqq c \leqq 15$ and $0.5 \leqq d \leqq 30$, the alloy being at least 50 percent by volume composed of an amorphous phase.

3. A high strength magnesium-based alloy consisting essentially of a composition represented by general formula (III):

$$Mg_aM_bLn_cX_d \quad (III)$$

wherein:

M is at least one element selected from the group consisting of Ni, Cu, Al, Zn and Ca; Ln is at least one element selected from the group consisting of Y, La, Ce, Sm and Nd or a misch metal (Mm) which is a combination of rare earth elements;

X is at least one element selected from the group consisting of Sr, Ba and Ga; and a, b, c and d are, in atomic percent, $55 \leqq a \leqq 95$, $3 \leqq b \leqq 25$, $1 \leqq c \leqq 15$ and $0.5 \leqq d \leqq 30$, the alloy being at least 50 percent by volume composed of an amorphous phase.

Since the magnesium-based alloys of the present invention have high levels of hardness, strength and heat-resistance, they are very useful as high strength materials and high heat-resistant materials. The magnesium-based alloys are also useful as high specific-strength materials because of their high specific strength Still further, the alloys exhibit not only a good workability in extrusion, forging or other similar operations but also a sufficient ductility to permit a large degree of bending (plastic forming). Such advantageous properties make the magnesium-based alloys of the present invention suitable for various industrial applications.

BRIEF DESCRIPTION OF THE DRAWING

The single FIGURE is a schematic illustration of an embodiment for producing the alloys of the present invention.

DETAILED DESCRIPTION OF THE PREFERRED EMBODIMENTS

The magnesium-based alloys of the present invention can be obtained by rapidly solidifying a melt of an alloy having the composition as specified above by means of liquid quenching techniques. The liquid quenching techniques involve rapidly cooling a molten alloy and, particularly, single-roller melt-spinning, twin-roller melt-spinning and in-rotating-water melt-spinning are mentioned as especially effective examples of such techniques. In these techniques, a cooling rate of about $10^4$ to $10^6$ K/sec can be obtained. In order to produce thin ribbon materials by the single-roller melt-spinning, twin-roller melt-spinning or the like, the molten alloy is ejected from the opening of a nozzle onto a roll of, for example, copper or steel, with a diameter of about 30–3000 mm, which is rotating at a constant rate of about 300–10000 rpm. In these techniques, various thin ribbon materials with a width of about 1–300 mm and a thickness of about 5–500 μm can be readily obtained. Alternatively, in order to produce fine wire materials by the in-rotating-water melt-spinning technique, a jet of the molten alloy is directed, under application of a back pressure of argon gas, through a nozzle into a liquid refrigerant layer having a depth of about 1 to 10 cm and held by centrifugal force in a drum rotating at a rate of about 50 to 500 rpm. In such a manner, fine wire materials can be readily obtained. In this technique, the angle between the molten alloy ejecting from the nozzle and the liquid refrigerant surface is preferably in the range of about 60° to 90° and the ratio of the relative velocity of the ejecting molten alloy to the liquid refrigerant surface is preferably in the range of about 0.7 to 0.9.

Besides the above techniques, the alloy of the present invention can also be obtained in the form of a thin film by a sputtering process. Further, rapidly solidified powder of the alloy composition of the present invention can be obtained by various atomizing processes such as, for example, high pressure gas atomizing or spray deposition.

Whether the rapidly solidified alloys thus obtained are amorphous or not can be confirmed by means of an ordinary X-ray diffraction method. When the alloys are amorphous, they show halo patterns characteristic of an amorphous structure. The amorphous alloys of the present invention can be obtained by the above-mentioned single-roller melt-spinning, twin-roller melt-spinning, in-rotating-water melt spinning, sputtering, various atomizing processes, spraying, mechanical alloying, etc. When the amorphous alloys are heated, the amorphous structure is transformed into a crystalline structure at a certain temperature (called "crystallization temperature Tx") or higher temperature.

In the magnesium-based alloys of the present invention represented by the above general formulas, "a", "b", "c" and "d" are defined as above. The reason for such limitations is that when "a", "b", "c" and "d" are outside their specified ranges, amorphization is difficult and the resultant alloys become very brittle. Therefore, it is impossible to obtain alloys having at least 50 percent by volume of an amorphous phase by the above-mentioned industrial processes, such as liquid quenching, etc.

The element "M" is at least one selected from the group consisting of Ni, Cu, Al, Zn and Ca and provides an improved ability to form an amorphous structure. Further, the group M elements improve the heat resistance and strength while retaining ductility. Also, among the "M" elements, Al has, besides the above effects, an effect of improving the corrosion resistance.

The element "Ln" is at least one selected from the group consisting of Y, La, Ce, Sm and Nd or a misch metal (Mm) consisting of rare earth elements. The elements of the group Ln improve the ability to form an amorphous structure.

The element "X" is at least one selected from the group consisting of Sr, Ba and Ga. The properties (strength and hardness) of the alloy of the present invention can be improved by addition of a small amount of the element "X". Also, the elements of the group "X" are effective for improving the amorphizing ability and the heat resistance of the alloys. Particularly, the group "X" elements provide a significantly improved amorphizing ability in combination with the elements of the groups "M" and "Ln" and improve the fluidity of the alloy melt.

Since the magnesium-based alloys of the general formulas as defined in the present invention have a high tensile strength and a low specific density, the alloys have large specific strength (tensile strength-to-density ratio) and are very important as high specific strength materials.

The alloys of the present invention exhibit superplasticity in the vicinity of the crystallization temperature, i.e., Tx±100° C., and, thus, can be successfully subjected to extrusion, pressing, hot-forging or other processing operations. Therefore, the alloys of the present invention, which are obtained in the form of a thin ribbon, wire, sheet or powder, can be readily consolidated into bulk shapes by extrusion, pressing, hot-forging, etc., within a temperature range of the crystallization temperature of the alloys ±100 K. Further, the alloys of the present invention have a high ductility sufficient to permit a bond-bending of 180°.

The present invention will be illustrated in more detail by the following examples.

EXAMPLES

A molten alloy 3 having a given composition was prepared using a high-frequency melting furnace and charged into a quartz tube 1 having a small opening 5 with a diameter of 0.5 mm at a tip thereof, as shown in the drawing. The quartz tube was heated to melt the alloy and was disposed right above a copper roll 2. The molten alloy 3 contained in the quartz tube 1 was ejected from the small opening 5 of the quartz tube 1 by applying an argon gas pressure of 0.7 kg/cm$^2$ and brought to collide against a surface of the copper roll 2 rapidly rotating at a revolution rate of 5000 rpm to provide a rapidly solidified alloy thin ribbon 4.

According to the processing conditions as set forth above, there were obtained 60 different alloy thin ribbons (width: 1 mm and thickness: 20 μm) having the compositions (by atomic %) given in Table 1. Each alloy thin ribbon was subjected to X-ray diffraction and it was confirmed that an amorphous phase was formed, as shown in Table 1.

Further, crystallization temperature (Tx) and hardness (Hv) were measured for each alloy thin ribbon sample. The results are shown in the right column of Table 1. The hardness Hv (DPN) is indicated by values measured using a vickers microhardness tester under a load of 25 g. The crystallization temperature (Tx) is the starting temperature (K) of the first exothermic peak in the differential scanning calorimetric curve which was obtained at a heating rate of 40 K/min. In Table 1, "Amo", "Amo+Cry", "Bri" and "Duc" are used to represent an amorphous structure, a composite structure of an amorphous phase and a crystalline phase, brittle and Ductile, respectively.

It can be seen from the data shown in Table 1 that all samples have a high crystallization temperature (Tx) of at least 390 K and a significantly increased hardness Hv(DPN) of at least 140, which is 1.5 to 3 times the hardness Hv(DPN) of 60 to 90 of conventional magnesium-based alloys.

Further, the magnesium-based alloys of the present invention have a broad supercooled liquid temperature range of 10 to 20 K and have a stable amorphous phase. Owing to such an advantageous temperature range, the magnesium-based alloys of the present invention can be processed into various shapes while retaining its amorphous structure, the processing temperature and time ranges are significantly broadened and, thereby various operations can be easily controlled.

TABLE 1

| | | Structure | Tx(K) | Hv (DPN) | |
|---|---|---|---|---|---|
| 1 | $Mg_{80}Ni_{12.5}Sr_{7.5}$ | Amo | 462.6 | 190 | Bri |
| 2 | $Mg_{82.5}Ni_{12.5}Sr_{5}$ | Amo | 464.7 | 188 | Bri |
| 3 | $Mg_{85}Ni_{12.5}Sr_{2.5}$ | Amo | 459 | 212 | Duc |
| 4 | $Mg_{85}Ni_{10}Sr_{5}$ | Amo | 462.4 | 170 | Bri |
| 5 | $Mg_{87.5}Ni_{10}Sr_{2.5}$ | Amo | 452.7 | 205 | Duc |
| 6 | $Mg_{87.5}Ni_{7.5}Sr_{5}$ | Amo | 449.6 | 194 | Duc |
| 7 | $Mg_{90}Ni_{7.5}Sr_{2.5}$ | Amo+Cry | — | 184 | Duc |

TABLE 1-continued

| | | Structure | Tx(K) | Hv (DPN) | |
|---|---|---|---|---|---|
| 8 | $Mg_{90}Ni_5Sr_5$ | Amo+Cry | — | 164 | Duc |
| 9 | $Mg_{92.5}Ni_5Sr_{2.5}$ | Amo+Cry | — | 164 | Duc |
| 10 | $Mg_{80}Ni_{15}Sr_5$ | Amo | 455.5 | 161 | Bri |
| 11 | $Mg_{82.5}Ni_{15}Sr_{2.5}$ | Amo | 461.2 | 181 | Duc |
| 12 | $Mg_{82.5}Ni_{10}Sr_{7.5}$ | Amo | 470.6 | 155 | Bri |
| 13 | $Mg_{85}Ni_{7.5}Sr_{7.5}$ | Amo | 460.2 | 164 | Bri |
| 14 | $Mg_{75}Ni_{20}Sr_5$ | Amo | 446.6 | 177 | Bri |
| 15 | $Mg_{75}Ni_{15}Sr_{10}$ | Amo | 453.7 | 188 | Bri |
| 16 | $Mg_{80}Ni_{10}Sr_{10}$ | Amo | 462.3 | 182 | Bri |
| 17 | $Mg_{80}Ni_5Sr_{15}$ | Amo | 468.7 | 166 | Bri |
| 18 | $Mg_{75}Ni_{10}Sr_{15}$ | Amo | 451.6 | 186 | Bri |
| 19 | $Mg_{84}Ni_{15}Sr_1$ | Amo | 458.3 | 250 | Duc |
| 20 | $Mg_{77.5}Ni_{20}Sr_{2.5}$ | Amo | 440.3 | 254 | Bri |
| 21 | $Mg_{86.5}Ni_{12.5}Sr_1$ | Amo | 453.1 | 170 | Duc |
| 22 | $Mg_{89}Ni_{10}Sr_1$ | Amo | 443.7 | 170 | Duc |
| 23 | $Mg_{81.5}Ni_{17.5}Sr_1$ | Amo | 450.9 | 209 | Duc |
| 24 | $Mg_{85}Ni_{14}Sr_1$ | Amo | 458.2 | 198 | Duc |
| 25 | $Mg_{83.25}Ni_{15}Sr_{1.75}$ | Amo | 462.1 | 198 | Duc |
| 26 | $Mg_{70}Zn_{20}Sr_{10}$ | Amo | 442.9 | 142 | Bri |
| 27 | $Mg_{65}Zn_{25}Sr_{10}$ | Amo | 457.0 | 212 | Bri |
| 28 | $Mg_{85}Cu_{12.5}Sr_{2.5}$ | Amo | 399.8 | 169 | Duc |
| 29 | $Mg_{82.5}Cu_{10}Sr_{7.5}$ | Amo | 418.0 | 177 | Bri |
| 30 | $Mg_{86.5}Cu_{12.5}Sr_1$ | Amo | 391.1 | 162 | Duc |
| 31 | $Mg_{77.5}Cu_{17.5}Sr_5$ | Amo | 423.8 | 198 | Bri |
| 32 | $Mg_{77.5}Cu_{10}Sr_{12.5}$ | Amo | 453.6 | 186 | Bri |
| 33 | $Mg_{70}Cu_{17.5}Sr_{12.5}$ | Amo | 475.5 | 203 | Bri |
| 34 | $Mg_{84}Ni_7Cu_7Sr_2$ | Amo | 428.5 | 197 | Duc |
| 35 | $Mg_{82.5}Ni_{12.5}Ba_5$ | Amo | 460.6 | 168 | Bri |
| 36 | $Mg_{85}Ni_{12.5}Ba_{2.5}$ | Amo | 465.4 | 157 | Bri |
| 37 | $Mg_{80}Ni_{12.5}Ba_{7.5}$ | Amo | 455.9 | 175 | Bri |
| 38 | $Mg_{82.5}Ni_{12.5}Al_{2.5}Sr_{2.5}$ | Amo+Cry | — | 167 | Duc |
| 39 | $Mg_{84}Ni_{12.5}Al_{2.5}Sr_1$ | Amo+Cry | — | 172 | Duc |
| 40 | $Mg_{82.5}Ni_{12.5}Ga_{2.5}$ | Amo | 469.5 | 222 | Duc |
| 41 | $Mg_{85}Ni_{10}Ga_5$ | Amo+Cry | — | 203 | Duc |
| 42 | $Mg_{85}Ni_{12.5}Ga_{2.5}$ | Amo | 459.9 | 220 | Duc |
| 43 | $Mg_{87.5}Ni_{10}Ga_{2.5}$ | Amo+Cry | — | 203 | Duc |
| 44 | $Mg_{82.5}Ni_{15}Ga_{2.5}$ | Amo | 467.0 | 225 | Duc |
| 45 | $Mg_{80}Ni_{12.5}Ga_{7.5}$ | Amo | 461.7 | 247 | Duc |
| 46 | $Mg_{82.5}Ni_{10}Ga_{7.5}$ | Amo | 462.1 | 243 | Duc |
| 47 | $Mg_{77.5}Ni_{15}Ga_{7.5}$ | Amo | 480.4 | 281 | Bri |
| 48 | $Mg_{80}Ca_5Ga_{15}$ | Amo+Cry | — | 180 | Duc |
| 49 | $Mg_{75}Ca_5Ga_{20}$ | Amo | 428.7 | 176 | Duc |
| 50 | $Mg_{80}Ca_5Ga_{15}$ | Amo+Cry | — | 173 | Duc |
| 51 | $Mg_{80}Y_5Ga_{15}$ | Amo+Cry | — | 183 | Duc |
| 52 | $Mg_{75}Y_5Ga_{20}$ | Amo | 397.5 | 172 | Duc |
| 53 | $Mg_{81}Ni_{10}Ce_7Ga_2$ | Amo | 470 | 214 | Duc |
| 54 | $Mg_{77.5}Ni_{12.5}Ga_{10}$ | Amo | 472 | 250 | Duc |
| 55 | $Mg_{75}Ni_{15}Ga_{10}$ | Amo | 486 | 236 | Bri |
| 56 | $Mg_{75}Ni_{10}Ga_{15}$ | Amo | 475.2 | 284 | Bri |
| 57 | $Mg_{70}Ni_{15}Ga_{15}$ | Amo | 487.6 | 324 | Bri |
| 58 | $Mg_{70}Ni_{10}Ga_{20}$ | Amo | 475 | 295 | Bri |
| 59 | $Mg_{65}Ni_{15}Ga_{20}$ | Amo | 493.3 | 352 | Bri |
| 60 | $Mg_{65}Ni_{10}Ga_{25}$ | Amo | 473.7 | 264 | Duc |

29 samples were chosen from the 60 alloy thin ribbons, 1 mm in width and 20 μm in thickness, made of the compositions (by atomic %) shown in Table 1 and by the same production procedure as described above, and tensile strength (δf) and fracture elongation ($\epsilon_{t.f.}$) were measured for each sample. Also, specific strength values, as shown in Table 2, were calculated from the results of the tensile strength measurements. As is evident from Table 2, every sample exhibited a high tensile strength δf of not less than 520 MPa and a high specific strength of not less than 218 MPa. As is clear from the results, the magnesium-based alloys of the present invention are far superior in tensile strength and specific strength over conventional magnesium-based alloys which have a tensile strength δf of 300 MPa and a specific strength of 150 MPa.

TABLE 2

| | Sample | Tensile Strength δf(MPa) | Fracture Elongation $\epsilon_{t.f.}$ (%) | Specific Strength (MPa) |
|---|---|---|---|---|
| 1 | $Mg_{85}Ni_{12.5}Sr_{2.5}$ | 753 | 2.1 | 338 |
| 2 | $Mg_{87.5}Ni_{10}Sr_{2.5}$ | 748 | 2.2 | 350 |
| 3 | $Mg_{87.5}Ni_{7.5}Sr_5$ | 650 | 1.8 | 311 |
| 4 | $Mg_{82.5}Ni_{15}Sr_{2.5}$ | 583 | 2.0 | 251 |
| 5 | $Mg_{84}Ni_{15}Sr_1$ | 858 | 1.9 | 365 |
| 6 | $Mg_{86.5}Ni_{12.5}Sr_1$ | 585 | 2.3 | 265 |
| 7 | $Mg_{89}Ni_{10}Sr_1$ | 550 | 2.0 | 261 |
| 8 | $Mg_{81.5}Ni_{17.5}Sr_1$ | 685 | 1.8 | 285 |
| 9 | $Mg_{85}Ni_{14}Sr_1$ | 710 | 2.6 | 313 |
| 10 | $Mg_{83.25}Ni_{15}Sr_{1.75}$ | 782 | 2.2 | 339 |
| 11 | $Mg_{85}Cu_{12.5}Sr_{2.5}$ | 520 | 1.9 | 230 |
| 12 | $Mg_{86.5}Cu_{12.5}Sr_1$ | 526 | 2.1 | 235 |
| 13 | $Mg_{84}Ni_7Cu_7Sr_2$ | 655 | 2.1 | 285 |
| 14 | $Mg_{82.5}Ni_{12.5}Al_{2.5}Sr_{2.5}$ | 577 | 2.1 | 251 |
| 15 | $Mg_{84}Ni_{12.5}Al_{2.5}Sr_1$ | 593 | 2.0 | 259 |
| 16 | $Mg_{82.5}Ni_{12.5}Ga_5$ | 742 | 1.7 | 310 |
| 17 | $Mg_{85}Ni_{10}Ga_5$ | 680 | 1.8 | 297 |
| 18 | $Mg_{85}Ni_{12.5}Ga_{2.5}$ | 730 | 1.8 | 319 |
| 19 | $Mg_{87.5}Ni_{10}Ga_{2.5}$ | 675 | 1.5 | 308 |
| 20 | $Mg_{82.5}Ni_{15}Ga_{2.5}$ | 752 | 1.5 | 315 |
| 21 | $Mg_{80}Ni_{12.5}Ga_{7.5}$ | 820 | 1.6 | 331 |
| 22 | $Mg_{82.5}Ni_{10}Ga_{7.5}$ | 807 | 1.2 | 339 |
| 23 | $Mg_{80}Ca_5Ga_{15}$ | 604 | 1.4 | 270 |
| 24 | $Mg_{75}Ca_5Ga_{20}$ | 590 | 2.1 | 244 |
| 25 | $Mg_{80}Ce_5Ga_{15}$ | 578 | 2.0 | 219 |
| 26 | $Mg_{80}Y_5Ga_{15}$ | 612 | 1.8 | 248 |
| 27 | $Mg_{75}Y_5Ga_{20}$ | 577 | 1.8 | 218 |
| 28 | $Mg_{81}Ni_{10}Ce_7Ga_2$ | 715 | 1.5 | 266 |
| 29 | $Mg_{77.5}Ni_{12.5}Ga_{10}$ | 830 | 1.5 | 322 |

Similar results were also obtained for $Mg_{87.5}Ni_5Sr_{7.5}$(Amo+Cry), $Mg_{85}Ni_5Sr_{10}$(Amo+Cry), $Mg_{75}Ni_5Sr_{20}$(Amo+Cry), $Mg_{70}Ni_{15}Sr_{15}$(Amo+Cry) and $Mg_{84}Cu_{15}Sr_1$(Amo).

What is claimed is:

1. A high strength magnesium-based alloy consisting essentially of a composition represented by general formula (II):

$$Mg_aLn_cX_d \quad \text{(II)}$$

wherein:

Ln is at least one element selected from the group consisting of Y, La, Ce, Sm and Nd or a misch metal (Mm) which is a combination of rare earth elements;

X is at least one element selected from the group consisting of Sr, Ba and Ga; and a, c and d are, in atomic %, $55 \leqq a \leqq 95$, $1 \leqq c \leqq 15$ and $0.5 \leqq d \leqq 30$, the alloy being at least 50 percent by volume composed of an amorphous phase.

2. A high strength magnesium-based alloy consisting essentially of a composition represented by general formula (III):

$$Mg_aM_bLn_cX_d \quad \text{(III)}$$

wherein:

M is at least one element selected from the group consisting of Ni, Cu, Al, Zn and Ca; Ln is at least one element selected from the group consisting of Y, La, Ce, Sm and Nd or a misch metal (Mm) which is a combination of rare earth elements;

X is at least one element selected from the group consisting of Sr, Ba and Ga; and a, b, c and d are, in atomic percent, $55 \leqq a \leqq 95$, $3 \leqq b \leqq 25$, $1 \leqq c \leqq 15$ and $0.5 \leqq d \leqq 30$, the alloy being at least 50 percent by volume composed of an amorphous phase.

3. The alloy of claim 1, wherein said alloy in $Mg_{80}Ce_5Ga_{15}$.

4. The alloy of claim 1, wherein said alloy is $Mg_{80}Y_5Ga_{15}$.

5. The alloy of claim 1, wherein said alloy is $Mg_{75}Y_5Ga_{20}$.

6. The alloy of claim 2, wherein said alloy is $Mg_{81}Ni_{10}Ce_7Ga_2$.

7. The alloy of claim 2, wherein M is at least one element selected from the group consisting of Ni, Cu, Zn and Ca.

* * * * *

UNITED STATES PATENT AND TRADEMARK OFFICE

CERTIFICATE OF CORRECTION

PATENT NO. : 5 221 376

DATED : June 22, 1993

INVENTOR(S) : Tsuyoshi Masumoto et al

It is certified that error appears in the above-identified patent and that said Letters Patent is hereby corrected as shown below:

Column 7, line 3; change "in" to ---is---.

Signed and Sealed this

Fifteenth Day of March, 1994

Bruce Lehman

*Attest:*

BRUCE LEHMAN

*Attesting Officer*

*Commissioner of Patents and Trademarks*